US007484645B2

(12) United States Patent
Hoff et al.

(10) Patent No.: US 7,484,645 B2
(45) Date of Patent: Feb. 3, 2009

(54) CHILD CARRIER WITH SIDE BUCKLE AND VENTING

(75) Inventors: Carrie Hoff, Beavercreek, OH (US); Thomas J. Witman, Huber Heights, OH (US); Bryan R. Keller, Springboro, OH (US); Cynthia R. Nelson, Longmont, CO (US); Joanne Berger, Denver, CO (US)

(73) Assignee: Evenflo Company, Inc.

( * ) Notice: Subject to any disclaimer, the term of this patent is extended or adjusted under 35 U.S.C. 154(b) by 726 days.

(21) Appl. No.: 11/057,411

(22) Filed: Feb. 14, 2005

(65) Prior Publication Data

US 2005/0184114 A1 Aug. 25, 2005

Related U.S. Application Data

(60) Provisional application No. 60/544,056, filed on Feb. 12, 2004.

(51) Int. Cl.
*A61G 1/00* (2006.01)
*A41F 1/00* (2006.01)

(52) U.S. Cl. ..... 224/160; 224/159; 24/702

(58) Field of Classification Search ..... 224/160; 24/438, 376, 374, 467, 490, 457, 702, 669, 24/201, DIG. 56, 163 R
See application file for complete search history.

(56) References Cited

U.S. PATENT DOCUMENTS

| | | | |
|---|---|---|---|
| 4,757,925 | A | 7/1988 | Knittel |
| 4,892,208 | A | 1/1990 | Sledge |
| 4,986,458 | A | 1/1991 | Linday |
| 4,986,599 | A | 1/1991 | Wise |
| 4,993,612 | A | 2/1991 | Quimby, Sr. et al. |
| 5,011,057 | A | 4/1991 | Perruzza et al. |
| 5,011,221 | A | 4/1991 | Wise |
| 5,205,450 | A | 4/1993 | Derosier |
| 5,244,292 | A | 9/1993 | Wise |
| 5,361,952 | A | 11/1994 | Gold |

(Continued)

FOREIGN PATENT DOCUMENTS

| | | |
|---|---|---|
| WO | WO 00/64297 | 11/2000 |

(Continued)

OTHER PUBLICATIONS

World Patent Search, [www.dialogweb.com], Dec. 19, 2002, pp. 1-10, The Dialog Corporation, Cary, North Carolina, USA.

*Primary Examiner*—Nathan J Newhouse
*Assistant Examiner*—Lester L Vanterpool
(74) *Attorney, Agent, or Firm*—Taft Stettinius & Hollister LLP

(57) ABSTRACT

A child carrier with a side buckle and ventilation features. The buckle includes a male portion and a female portion. The male portion of the buckle is shaped to mate with the female portion simply and easily, yet securely attaches the side portion of the carrier to the front/strap portion of the carrier. The buckle is robust, yet easy to use and does not easily disengage without a deliberate movement by the wearer thereof. The ventilation features provide comfort to the child carried in the carrier as well as the wearer thereof and are comprised of a ventilation panel that may be open, releasably closed, or accessed through a slit.

17 Claims, 6 Drawing Sheets

U.S. PATENT DOCUMENTS 5,454,498 A 10/1995 Dunn et al.
5,490,620 A 2/1996 Bergqvist
5,522,528 A 6/1996 Petricola
5,570,823 A * 11/1996 Lindy ..... 224/160
5,609,279 A 3/1997 O'Shea
5,632,425 A 5/1997 Hull
5,690,258 A 11/1997 Kataoka
5,730,490 A * 3/1998 Mortenson ..... 297/184.13
5,732,861 A 3/1998 Jakobson
5,772,088 A 6/1998 Nelson
5,772,279 A 6/1998 Johnson, Jr.
5,791,535 A * 8/1998 Roan et al. ..... 224/160
5,813,580 A 9/1998 Fair
5,988,670 A 11/1999 Song et al.
6,070,890 A 6/2000 Haut et al.
6,095,614 A 8/2000 Canna et al.
6,098,856 A 8/2000 Reilly
6,098,857 A 8/2000 Le Gal
6,186,381 B1 2/2001 Kernkamp
6,213,362 B1 4/2001 Lorenzini et al.
6,244,483 B1 6/2001 McLemore et al.
6,247,755 B1 6/2001 Canna et al.
6,318,608 B1 11/2001 Fowler et al.
6,331,032 B1 12/2001 Haut et al.
6,363,558 B1 4/2002 Dunne
6,491,195 B1 12/2002 McLemore et al.
6,763,983 B2 * 7/2004 Norman ..... 224/160

FOREIGN PATENT DOCUMENTS

WO WO 01/05264 A1 1/2001
WO WO 01/84984 A1 11/2001

* cited by examiner

CHILD CARRIER WITH SIDE BUCKLE AND VENTING

CROSS REFERENCE TO RELATED APPLICATIONS

This application claims the benefit of U.S. Provisional Application Ser. No. 60/544,056 filed Feb. 12, 2004 and entitled "CHILD CARRIER WITH SIDE BUCKLE AND VENTING," the disclosure of which is incorporated herein by reference.

FIELD OF THE INVENTION

The present invention is directed to a child carrier for carrying a child, and more particularly, to improvements in such a carrier that make it more comfortable for a child seated therein as well as which make it easier for an adult wearer thereof to secure the child therein.

BACKGROUND OF THE INVENTION

Child carriers permit transportation of a child within a backpack-type structure that may be worn by a wearer. Child carriers are generally considered to be of two types, hard carriers and soft carriers. Hard carriers generally include a rigid frame fabricated from either metal or plastic tubing, and generally include a child seating area in which a child may be secured (typically through the use of one or more belts), and a mounting portion to which shoulder straps are attached to support the carrier on the back of a wearer. Soft carriers are generally similar in construction to hard carriers but do not include a rigid frame. Additionally, both hard and soft carriers may include waist belts that allow the wearer to secure the lower portion of the carrier firmly against the wearer's waist and/or lower back.

Prior art child carriers have generally had features that make them easier for a wearer to secure the child therein and which provide additional comfort to a child carried therein. For example, U.S. Pat. Nos. 5,490,620 and 5,732,861 discloses a buckle mechanism for a child carrier of the type discussed herein. Additionally, WO 01/84984 A1 discloses a buckle mechanism which is comprised of a single plastic finger-like projection that engages a sewn pocket on the carrier. While that type of buckle is easy and simple to use, it generally is not as robust as would be desired since essentially the entire weight of the upper outside portion of the carrier is supported by only a single, narrow portion of the finger. Additionally, that type of buckle does not include any kind of interlock or two step securing method. Accordingly, while the weight of the child should generally keep that buckle engaged, the disengagement of that buckle can be accomplished unexpectedly if the child's weight is not pushing down on the bottom of the carrier.

In addition to having the child held in the carrier using a buckle that is robust, easy and simple to manipulate, it is also desired that the child be held in the carrier as comfortably as possible. Considering the fact that carriers may be used in the outside when temperatures are relatively high, and given the fact that most carriers are made of materials that may not allow significant air-flow through to the child, it is desirable to provide a carrier with the ability to vent air to the child and/or the wearer of the carrier. In this regard, U.S. Pat. No. 5,570,823 discloses that side panels of a carrier may be made of mesh in order to improve ventilation to the child. However, it is noted that sometimes the carrier may be used when the ambient temperature and/or the baby temperature makes it desirable that the baby and/or the wearer be kept as warm as possible. Furthermore, the ventilation for the child in the carrier may often be needed most on the back or the front of the child (depending on the orientation of the child in the carrier), as opposed to the sides of the child.

Accordingly, for all of these reasons, it would be desirable to provide a buckle for use with a child carrier that is robust, easy to use, and which resists unwanted disengagement of the buckle. Furthermore, it would be desirable to have an infant carrier that provides ventilation to a child carried in the carrier on the child's front or back, and the wearer thereof, when such ventilation is desired, but which also has the ability to reduce or eliminate the ventilation properties thereof when ventilation is not desired.

SUMMARY OF THE INVENTION

The present invention is directed to improvements in soft and/or hard child carriers by providing a buckle mechanism that is robust, easy to use and resists undesired disengagement. Additionally, the present invention provides improved ventilation for a child carried in the carrier, as well as the wearer of the carrier, which is preferably configured for selective engagement depending on whether or not ventilation is desired.

An exemplary embodiment of the present invention includes a child carrier with a side buckle. The buckle includes a male portion and a female portion. The male portion of the buckle is shaped to mate with the female portion simply and easily, yet securely attaches the side portion of the carrier to the front/strap portion of the carrier. The buckle is robust, yet easy to use and does not easily disengage without a deliberate movement by the wearer thereof.

The ventilation features of the present invention provide comfort to the child carried in the carrier as well as the wearer thereof. Generally, the vents are provided on the front or back support sections of the carrier and may be selectively openable via a selectively releasable closure device, such as a zipper, that is attached to a flap. The flap thus may be opened via the closure device when ventilation is desired or closed when ventilation is not desired. Preferably ventilation is provided by a mesh fabric, although other breathable fabrics (or no fabric or material at all) may be used to provide ventilation if desired. In alternate embodiments, the ventilation area or panel may be covered, at least in part, at all times by a fabric flap and the fabric flap may include a slit or larger opening therein for air flow access to the ventilation panel. The slit may include pleats therearound if desired. In another embodiment, the ventilation panel may comprise the entire front and/or back support of the carrier.

DETAILED DESCRIPTION

The exemplary embodiments of the present invention are described and illustrated below in reference to the drawings included herewith. The various orientational, positional, and reference terms used to describe the elements of the exemplary embodiments are therefore used according to this frame of reference. However, for clarity and precision, only a single orientational or positional reference will be utilized. Therefore, it will be understood that the positional and orientational terms used to describe the elements of the exemplary embodiments of the present invention are only used to describe the elements in relation to one another.

Figure 1:
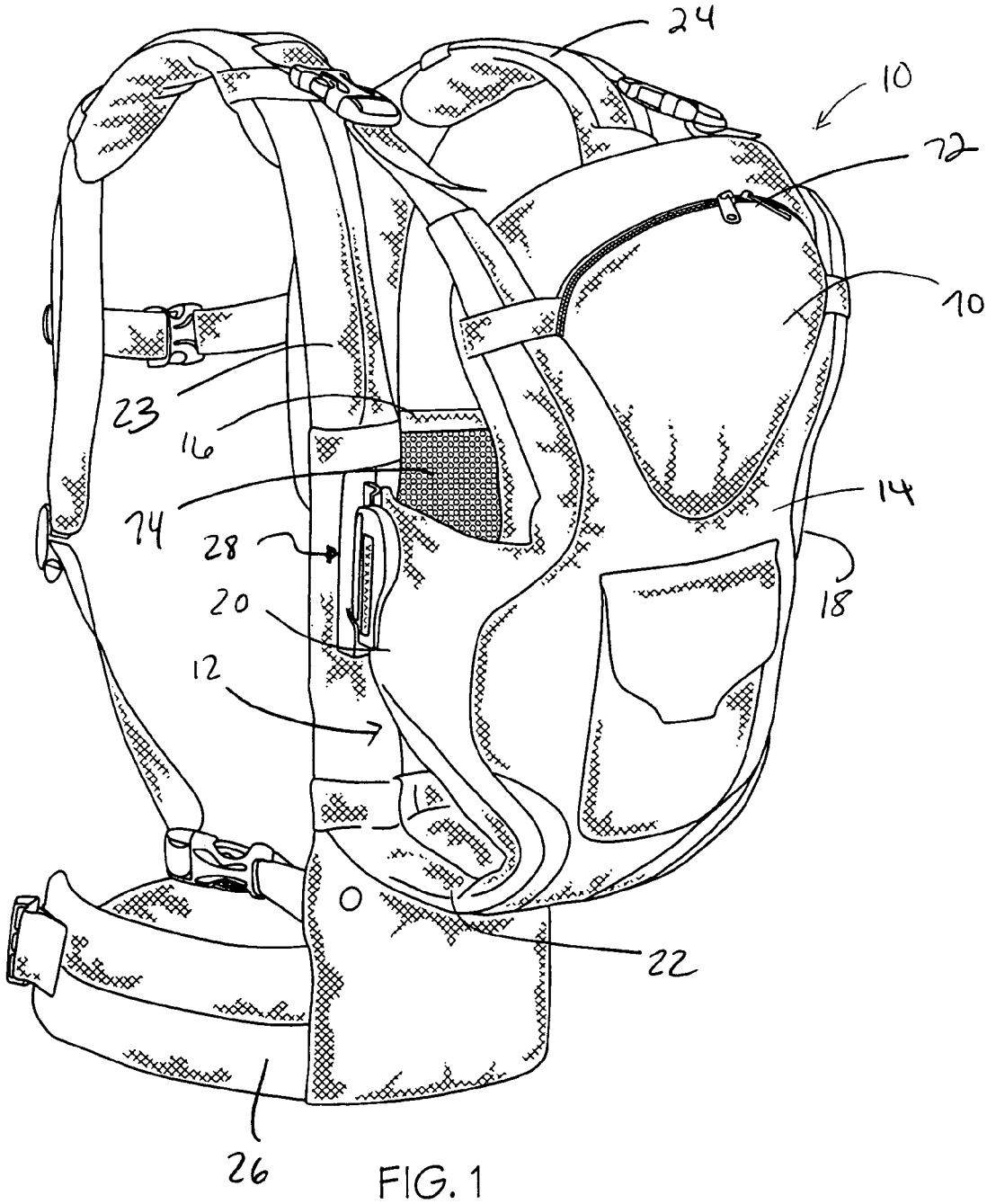
FIG. 1 is a side perspective view of an exemplary embodiment of a child carrier incorporating desired features in accordance with the present invention.
Figure 2:
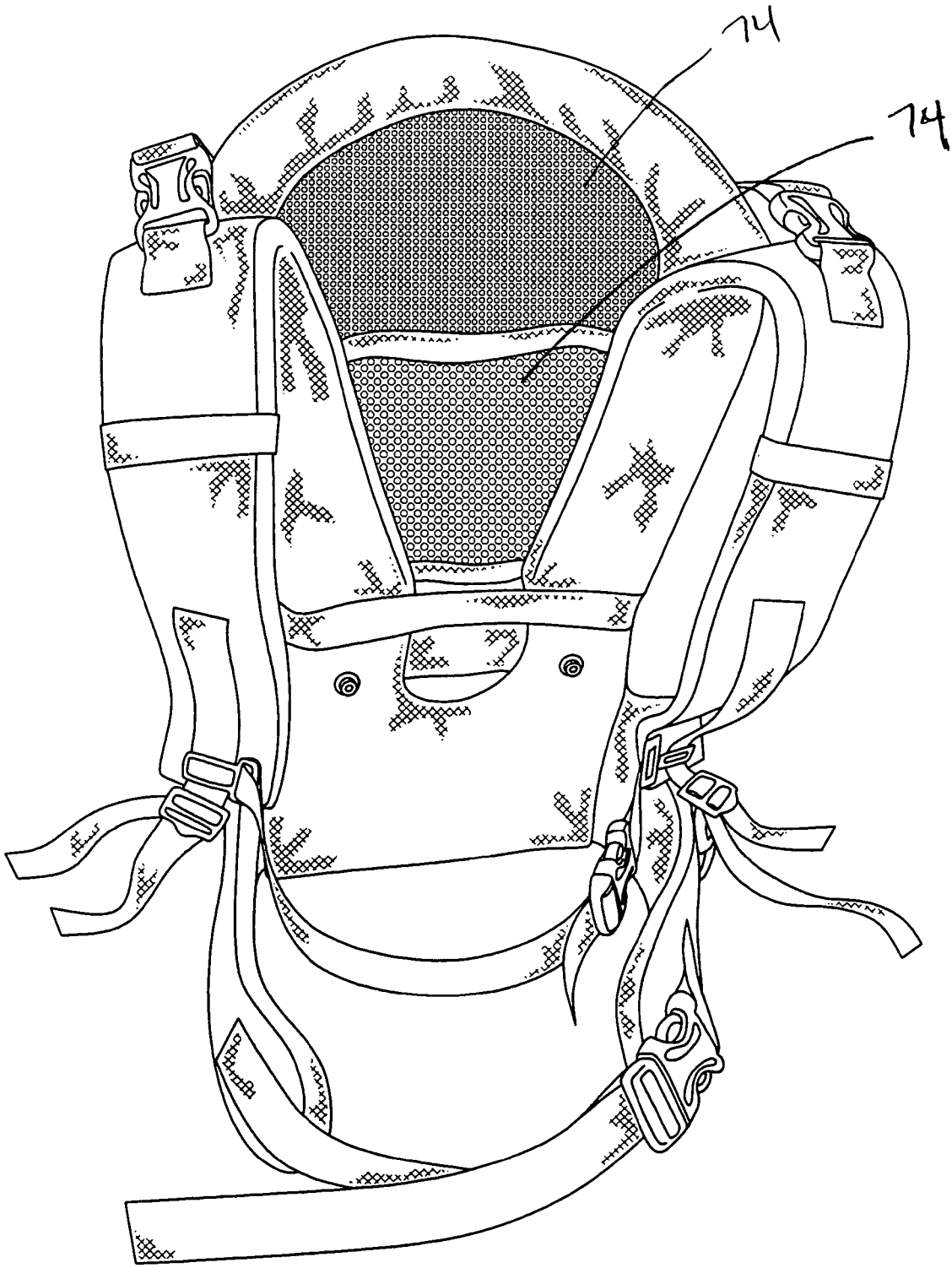
FIG. 2 is a front perspective view of a portion of the exemplary child carrier of FIG. 1.

Referencing FIG. 1, a child carrier 10 is shown having a child seating area 12 for supporting a child therein. The child seating area 12 includes a back support 14, a front support 16, a right side support 18, and a left side support 20, where the side supports 16, 18 bridge and couple the back support 14 to the front support 16. A crotch support 22 spans between the front support 16 and back support 14 and is coupled thereto to distribute the weight of the child. The child carrier 10 also includes shoulder straps 23, 24 and a waist strap 26 to be secured to a wearer of the carrier 10.

As shown best in FIGS. 4-7, the left side support 20 includes a side buckle 28 in accordance with the invention. As best seen in FIGS. 4-7, the buckle 28 includes a male portion 30, and a female portion 32. The male portion 30 preferably includes a hand tab 34 for easy grasping by a wearer for engaging the male portion 30 to the female portion 32. The male portion 30 also preferably includes a first loop 36 for pivotably receiving a belt 38 or a portion of the left side support 20. The male portion 30 also preferably includes a second loop 40 for engaging the female portion 32 of the buckle 28. The outside portion 42 of the second loop 40 preferably includes an extension portion 44 which extends down below the lower extent 46 of the second loop 40.

The female portion 32 of the buckle 28 is preferably stitched or otherwise incorporated into the left side of the front support 16 or shoulder strap 23 via a baseplate 48. The baseplate 48 preferably includes a slot 50 therein for receiving the outside portion 42 of the second loop 40 of the male portion 32. The female portion also preferably includes a flange 52 having an upper notch 56 therein, a sliding surface 58 and a lower support floor 62, all of which are attached to the baseplate 48 and which are shaped to receive and secure the outside portion 42 of the second loop 40 of the male portion to the female portion 32. More specifically, the slot 50 is shaped to initially receive the extension portion 44 and the rest of the outside portion 42 of the second loop 40 such that the outside portion may be slid downwardly through slot 50. Then, when the lower extent 46 of the second loop 40 contacts the sliding surface 58, the male portion 30 is rotated so that the second loop 40 captures flange 52 therein such that the upper portion 66 of the second loop 40 rests upon the upper portion of the upper notch 56 and the bottom of the extension portion 44 rests upon the support floor 62.

Figure 3:
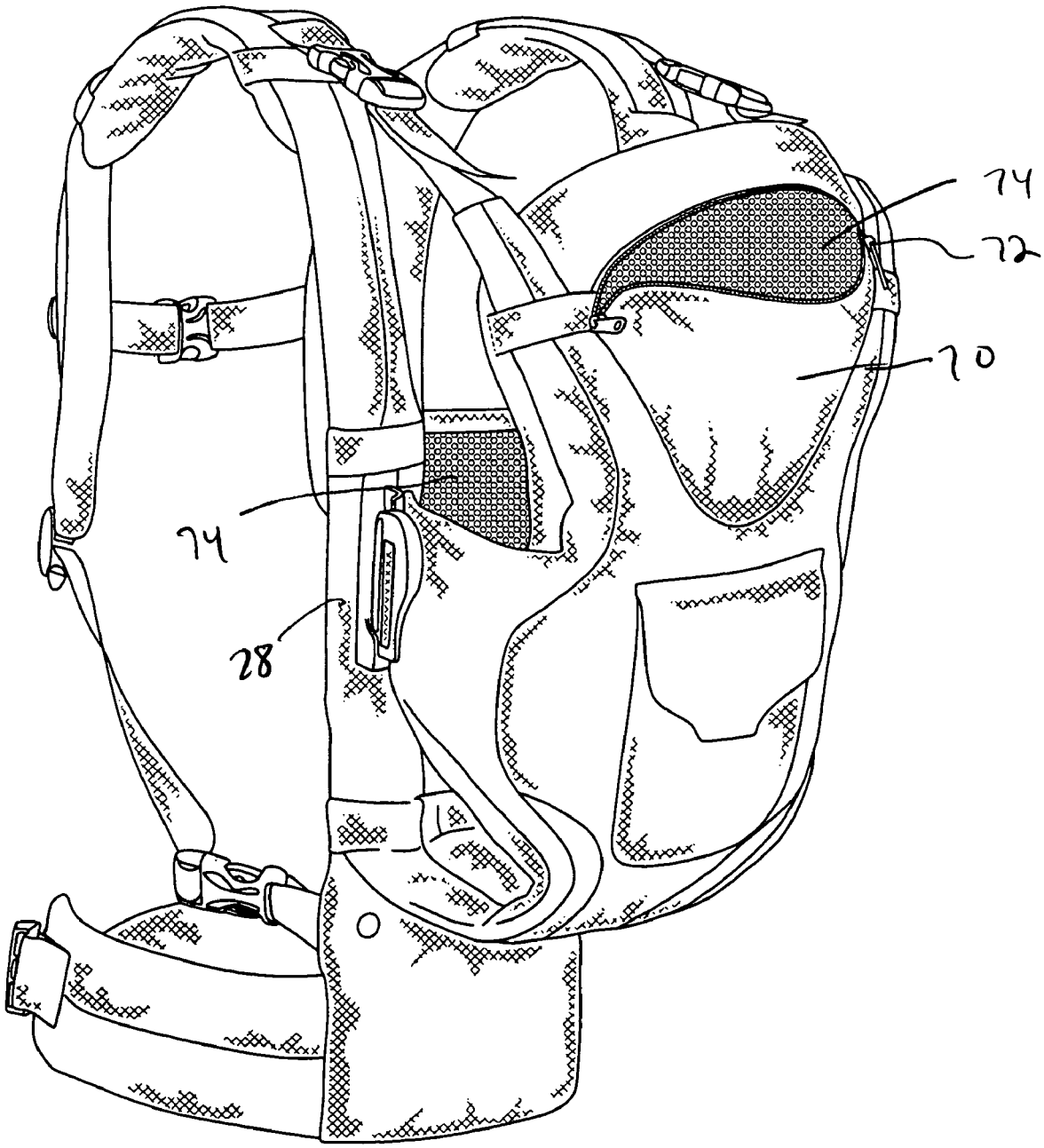
FIG. 3 is a side perspective view of the child carrier of FIG. 1 showing an exemplary ventilation engagement feature in accordance with the present invention.
Figure 4:
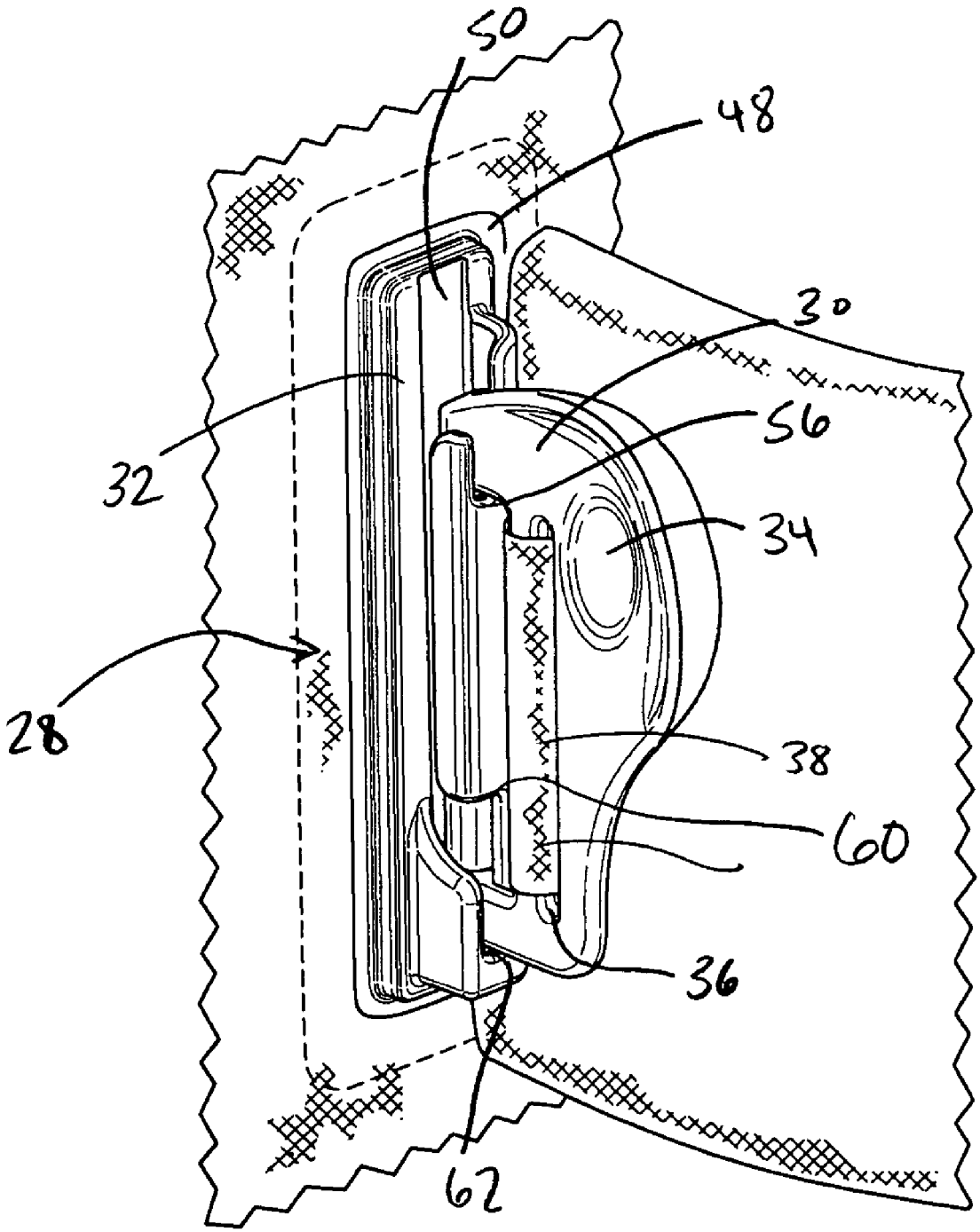
FIG. 4 is a detail side perspective view of a buckle in accordance with the present invention shown attached to the carrier of FIG. 1.
Figure 7:
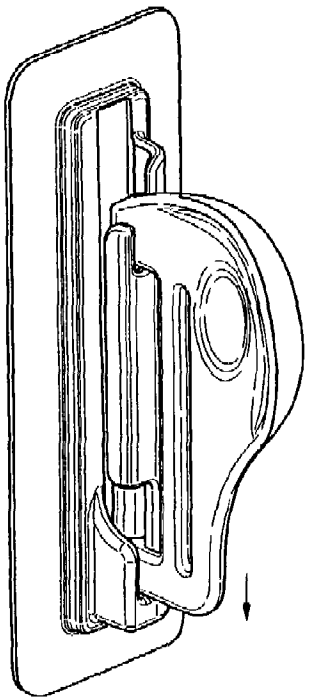
FIG. 7 is a detail side perspective view of the buckle of FIG. 4 shown with the male and female portions in the final engagement position.
Figure 6:
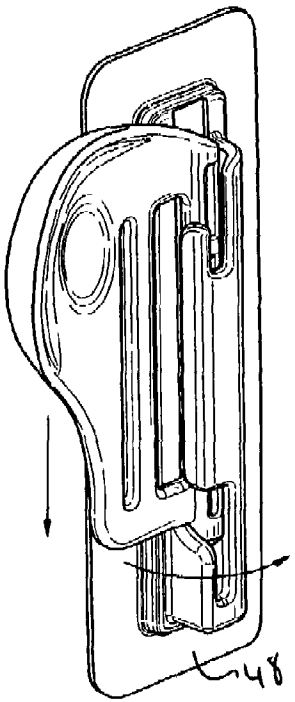
FIG. 6 is a detail side perspective view of the buckle of FIG. 4 shown with the male portion of the buckle in initial engagement with the female portion of the buckle.
Figure 5:
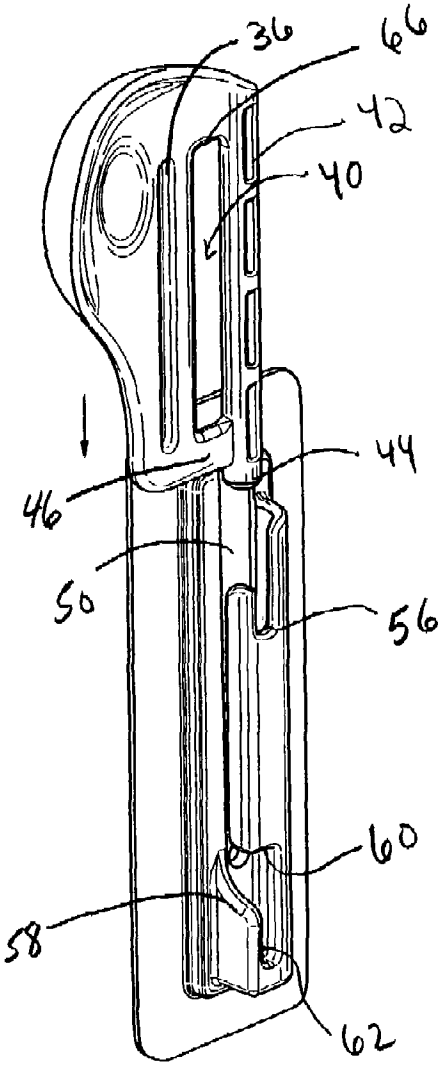
FIG. 5 is a detail side perspective view of the buckle of FIG. 4 shown with the male portion of the buckle disengaged from the female portion of the buckle.

The ventilation features of the present invention are shown best in FIGS. 1-4 and 8-9. In a first exemplary embodiment of the ventilation feature, the back support 14 is provided with a flap 70, the flap 70 including a zipper 72, or other type of selectively releasable closure, attached to an upper extent thereof. Underneath the flap 70, as best shown in FIG. 3, is a ventilation panel 74, preferably made of a mesh or other breathable fabric (or conversely not including any fabric whatsoever). In accordance with the invention, therefore, when ventilation is desired for the child in the child seating area 12, the zipper 72 is unzipped and the flap 70 is pushed downward (as shown best in FIG. 3), thereby allowing air flow through the ventilation panel 74 to the child. Conversely, when ventilation is not desired, the zipper 72 is zipped thereby preventing air flow through the ventilation panel 74.

Figure 8:
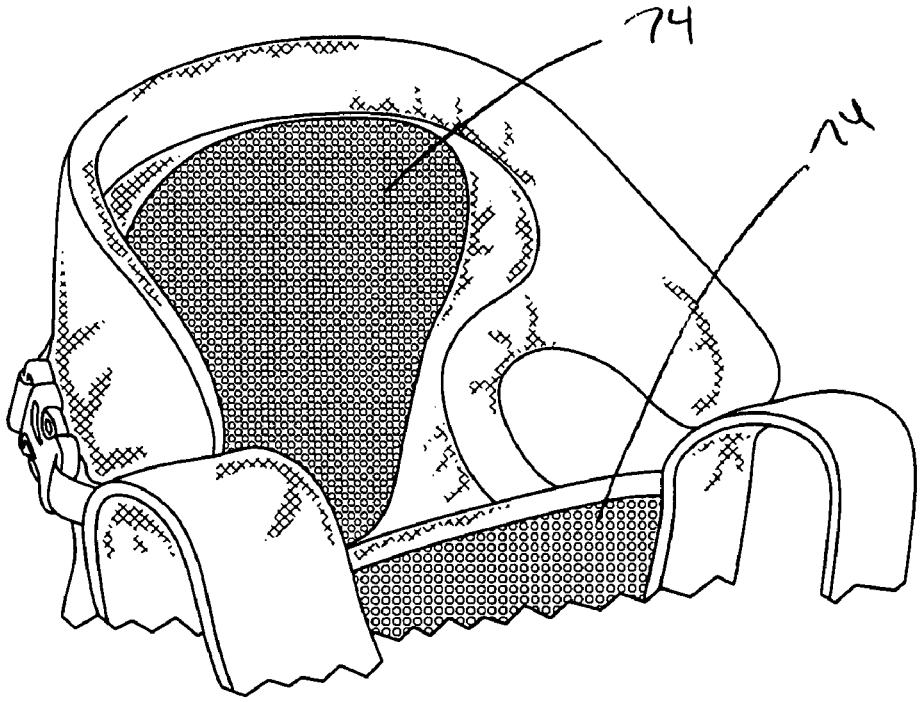
FIG. 8 is a front perspective view of an alternate embodiment of a venting feature for use in connection with the exemplary child carrier of FIG. 1.
Figure 9:
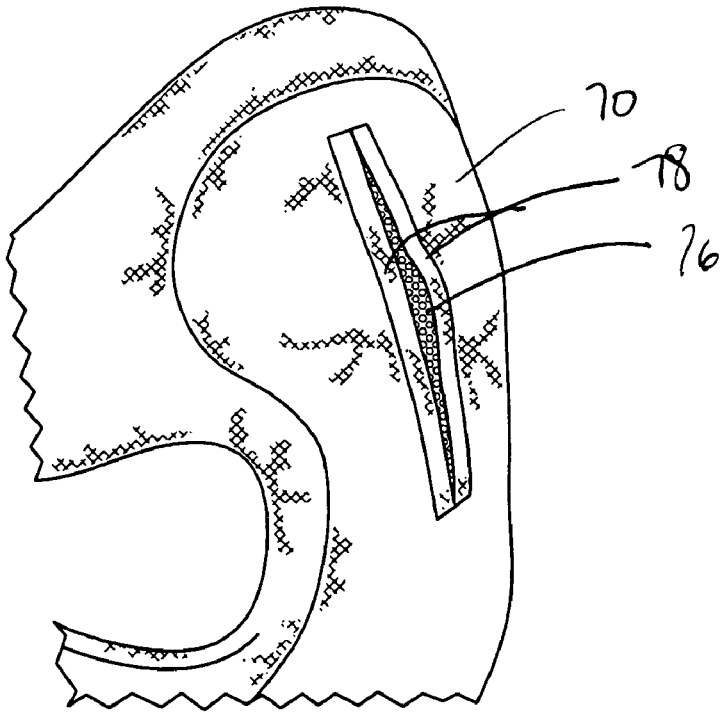
FIG. 9 is a rear perspective view of an alternate embodiment of a venting feature for use in connection with the exemplary child carrier of FIG. 1.

In an alternate embodiment, as best shown in FIGS. 8 and 9, instead of providing a selectively releasable closure 72, the ventilation panel 74 may be covered on one side (preferably the outer side away from the child seating area 12) with a fabric flap 70 having a slit 76 or opening therethrough. The slit 76 or opening may be of any size or shape as desired and may even cover the entire area of the ventilation panel 74. The slit may have pleats 78 on either side thereof if desired.

Additionally, it is noted that the front support 16 may be made partially or completely out of a mesh fabric (or may include fabric-less voids therein) in order to provide additional ventilation to the child or the wearer or may include a ventilation panel 74 as described above. It is further noted that the selectively closeable and slit ventilation features discussed above with respect to the back support 14 may be incorporated with equal utility to the front support 16.

What is claimed is:

1. A child carrier comprising:

a child seating area for supporting a child therein comprising a back support, a front support, a right side support, a left side support, and a crotch support, wherein said left and right side supports and said crotch support and connect the back support to the front support;

shoulder straps operatively coupled to said child seating area;

at least one buckle for releasably coupling one of said right or left side supports to one of said back or front supports, said buckle including a male portion and a female portion, wherein said male portion includes a securing loop and said female portion includes a flange having a notch in an upper extent thereof, said flange forming a slot for receiving said securing loop and said notch shaped to receive an upper inside portion of said securing loop therein.

2. The child carrier of claim 1 wherein said male portion further comprises a hand tab formed thereon.

3. The child carrier of claim 1 wherein said male portion further includes an attachment loop for pivotably attaching said male portion to one of said back, front, left, or right said supports.

4. The child carrier of claim 1 wherein said male portion further includes an extension portion located on the lower extent of the scouring loop and said female portion includes a sliding surface and a support floor, said support floor shaped to receive and support said extension portion.

5. The child carrier of claim 1 further comprising a flap provided on one of said front or back supports including a releasable closure thereon covering a ventilation panel.

6. The child carrier of claim 5 wherein said ventilation panel is covered in a mesh fabric.

7. The child carrier of claim 6 wherein said releasable closure is a zipper.

8. The child carrier of claim 1 wherein one of said front or back supports includes a mesh ventilation panel incorporated therein.

9. The child carrier of claim 8 wherein said mesh ventilation panel is covered by a fabric flap having a slit therethrough.

10. The child carrier of claim 9 wherein said fabric flap includes pleats on either side of said slit.

11. A method for securing a buckle on a child carrier using three distinct motions comprising the steps of:

selecting a child carrier including a child seating area for supporting a child therein comprising a back support, a front support, a right side support, a left side support, and a crotch support, wherein said left and right side supports and said crotch support and connect the back support to the front support;

selecting a child carrier including shoulder straps operatively coupled to said child seating area;

selecting a buckle for said child carrier for releasably coupling one of said right or left side supports to one of said back or front supports, said buckle including a male portion and a female portion, wherein said male portion includes a securing loop and said female portion includes a flange having a notch in an upper extent thereof, said flange forming a slot for receiving said securing loop and said notch shaped to receive an upper inside portion of said securing loop therein;

in a first motion, grasping said male portion of said buckle and inserting it downwardly in said slot;

in a second motion, rotating said male portion of said buckle such that said securing loop captures said flange therein; and in a third motion, pushing said male portion downwardly such that an upper inside portion of said securing loop is captured in said notch.

12. The method of claim 11 further comprising the step of selecting a buckle having a male portion having a hand tab formed thereon.

13. The method of claim 11 further comprising the step of selecting a buckle wherein said male portion further includes an extension portion located on the lower extent of the securing loop and said female portion includes a sliding surface and a support floor, wherein said support floor shaped to receive and support said extension portion and wherein said step of rotating said male portion of said buckle to capture said flange in said securing loop is accomplished when a bottom outside portion of said securing loop contacts said sliding surface.

14. The method of claim 11 further comprising the step of selecting a child carrier having a ventilation panel formed in one of said back or front supports.

15. The method of claim 14, wherein the ventilation panel i s covered in a mesh fabric.

16. The method of claim 14, wherein the step of selecting a child carrier includes selecting a child carrier including a flap covering the ventilation panel, the flap including a releasable closure thereon.

17. The method of claim 16, wherein the releasable closure is a zipper.

* * * * *